US005448945A

United States Patent [19]

Taylor et al.

[11] Patent Number: 5,448,945

[45] Date of Patent: Sep. 12, 1995

[54] COMBINATION COMPACTING AND LIFTING APPARATUS

[75] Inventors: Richard E. Taylor, Oklahoma City; James D. Blanton, Edmond, both of Okla.

[73] Assignee: LiftPak, L.C., Oklahoma City, Okla.

[21] Appl. No.: 375,212

[22] Filed: Jan. 18, 1995

Related U.S. Application Data

[63] Continuation of Ser. No. 148,737, Nov. 5, 1993, abandoned, which is a continuation-in-part of Ser. No. 2,568, Jan. 11, 1993, abandoned.

[51] Int. Cl.[6] ..... B30B 15/00

[52] U.S. Cl. ..... 100/100; 100/116; 100/229 A; 280/47.34; 414/495

[58] Field of Search ..... 100/100, 116, 131, 229 A, 100/110; 187/9 R; 280/47.34; 298/2, 11; 414/424, 471, 495

[56] References Cited

U.S. PATENT DOCUMENTS

| | | | |
|---|---|---|---|
| 2,881,865 | 4/1959 | Lewis | 187/47.34 X |
| 3,589,277 | 6/1971 | Gray et al. | 100/229 A X |
| 3,726,211 | 4/1973 | Gladwin | 100/100 |
| 3,731,618 | 5/1973 | Leman | 100/229 A |
| 3,748,820 | 7/1973 | Fox | 100/229 A X |
| 3,757,682 | 9/1973 | Ritchie | 100/229 A X |
| 3,808,967 | 5/1974 | Fair et al. | 100/229 A X |
| 3,827,348 | 8/1974 | Hennells | 100/110 X |
| 3,831,513 | 8/1974 | Tashman | 100/100 X |
| 3,863,985 | 2/1975 | Zuber | 298/2 |
| 3,890,890 | 6/1975 | Hennells | 100/229 A X |
| 3,903,790 | 9/1975 | Gladwin | 100/229 A X |
| 3,967,548 | 7/1976 | Moriconi | 100/229 A |
| 4,000,689 | 1/1977 | Weeks et al. | 100/229 A |
| 4,152,035 | 5/1979 | Fox | 100/229 A X |
| 4,156,386 | 5/1979 | Gould | 100/229 A X |
| 4,275,651 | 6/1981 | Groth et al. | 100/229 A |
| 4,483,248 | 11/1984 | Ostreng | 100/100 X |
| 4,638,730 | 1/1987 | Bonacorsi | 100/229 A |
| 4,677,909 | 7/1987 | Beesley et al. | 100/229 A |
| 4,700,623 | 10/1987 | Durbin et al. | 100/100 X |
| 5,012,732 | 5/1991 | Fox | 100/229 A X |
| 5,022,810 | 6/1991 | Sherrow et al. | 414/495 X |
| 5,062,358 | 11/1991 | Fox | 100/229 A X |
| 5,092,233 | 3/1992 | Fox | 100/229 A X |
| 5,213,695 | 5/1993 | Pinder | 100/116 X |

OTHER PUBLICATIONS

Exhibit A. A brochure entitled Introducing the Ultimate High Performance Trash Compaction System, published by International Compactor Incorporated, (date unknown).

Exhibit B. Page 5 of a brochure entitled Commercial (Indoor) Compactors, published by Marathon, (date unknown).

*Primary Examiner*—Stephen F. Gerrity

[57] ABSTRACT

A combination material compacting and moving apparatus comprising a compactor and a cart. The compactor having a ram reciprocatingly mounted therein for compacting material onto the cart. The cart includes a lifting and dumping mechanism so the compacted materials may be transported, lifted and dumped at a remote location without the operator coming in contact with the compacted material or its container. The compactor and the cart include numerous liquid control elements including: a compactor housing having an upper reception chamber and a lower storage chamber wherein the reception chamber has protruding walls with a drip edge so that any liquid splashed on the reception chamber walls will drip into the material container; a return member which extends from the protruding walls to the storage walls at an angle so any liquid which may be splashed on the return member will be pulled gravitationally away from the storage chamber walls and drip into the container; a bag holder on the cart to support and direct a container into position so material can be compacted therein, wherein the bag holder is guided up against the return member, preventing liquid from escaping the container.

21 Claims, 8 Drawing Sheets

COMBINATION COMPACTING AND LIFTING APPARATUS

CROSS-REFERENCE TO RELATED APPLICATIONS

This is a continuation of application Ser. No. 08/148,737 was filed Nov. 5, 1993 (abandoned) entitled A COMBINATION COMPACTING AND LIFTING APPARATUS, which is a continuation-in-part of application Ser. No. 08/002,568, filed Jan. 11, 1993 abandoned, entitled A COMBINATION COMPACTING AND LIFTING APPARATUS.

FIELD OF THE INVENTION

The present invention relates generally to devices for compacting and transporting material. More particularly, the present invention relates to a compacting apparatus which prevents the escape of liquids wherein the invention includes having a cart to transport and lift the material so it can be dumped into a receptacle such as a trash bin.

SUMMARY OF THE INVENTION

The present invention comprises a material compacting and transporting apparatus. The apparatus includes a compactor housing with a reciprocating ram for compacting material and a cart onto which the material is compacted. The cart may be removed from the compactor housing and pushed to a remote location where the compacted material can be dumped. The cart includes a lifting mechanism for raising the compacted material and a release lever for automatically dumping the compacted material. By way of example, trash may be compacted in a bag and then moved from the compactor housing and dumped in a trash bin without the operator ever having to lift or even touch the compacted trash or the container holding it.

The invention may also include several elements to prevent the leakage or spillage of liquids which may be associated with the material to be compacted. For example, the compactor housing has an upper reception chamber and a lower storage chamber. The reception chamber has protruding walls thus providing a drip edge so that any liquid splashed on the reception chamber walls will drip into the material container. A return member extends from the protruding walls to the storage chamber walls at an angle so any liquid which may be splashed on the return member will be pulled gravitationally away from the storage chamber walls and drip into the container.

A bag holder is provided on the cart to support a container into position so material can be compacted therein. The bag holder is guided up against the return member when the cart is in position for the compactor to operate, thus sealing the container to the return member and preventing liquid from escaping the container.

BRIEF DESCRIPTION OF THE DRAWINGS

FIG. 6 is a cross-sectional view of the apparatus of FIG. 1 with the cart in position for compacting.

DESCRIPTION OF THE PREFERRED EMBODIMENTS

Figure 1:
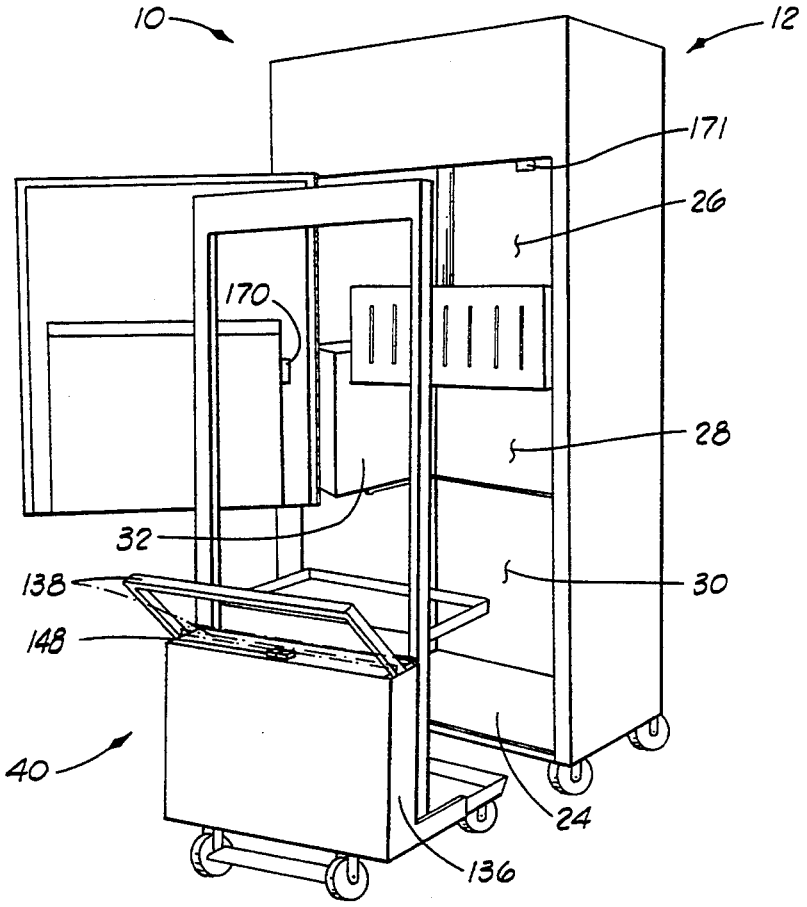
FIG. 1 is a schematic representation of a combination compacting and lifting apparatus made in accordance with one embodiment of this invention.
Figure 3:
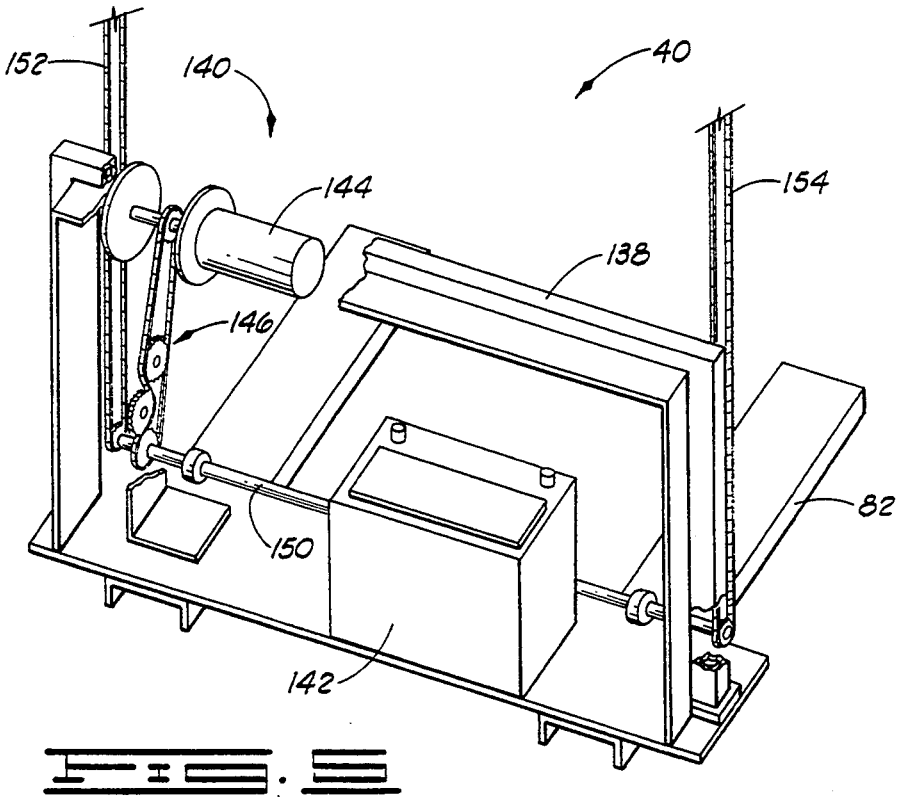
FIG. 3 is a rear isometric representation of the compactor of FIG. 1.
Figure 2:
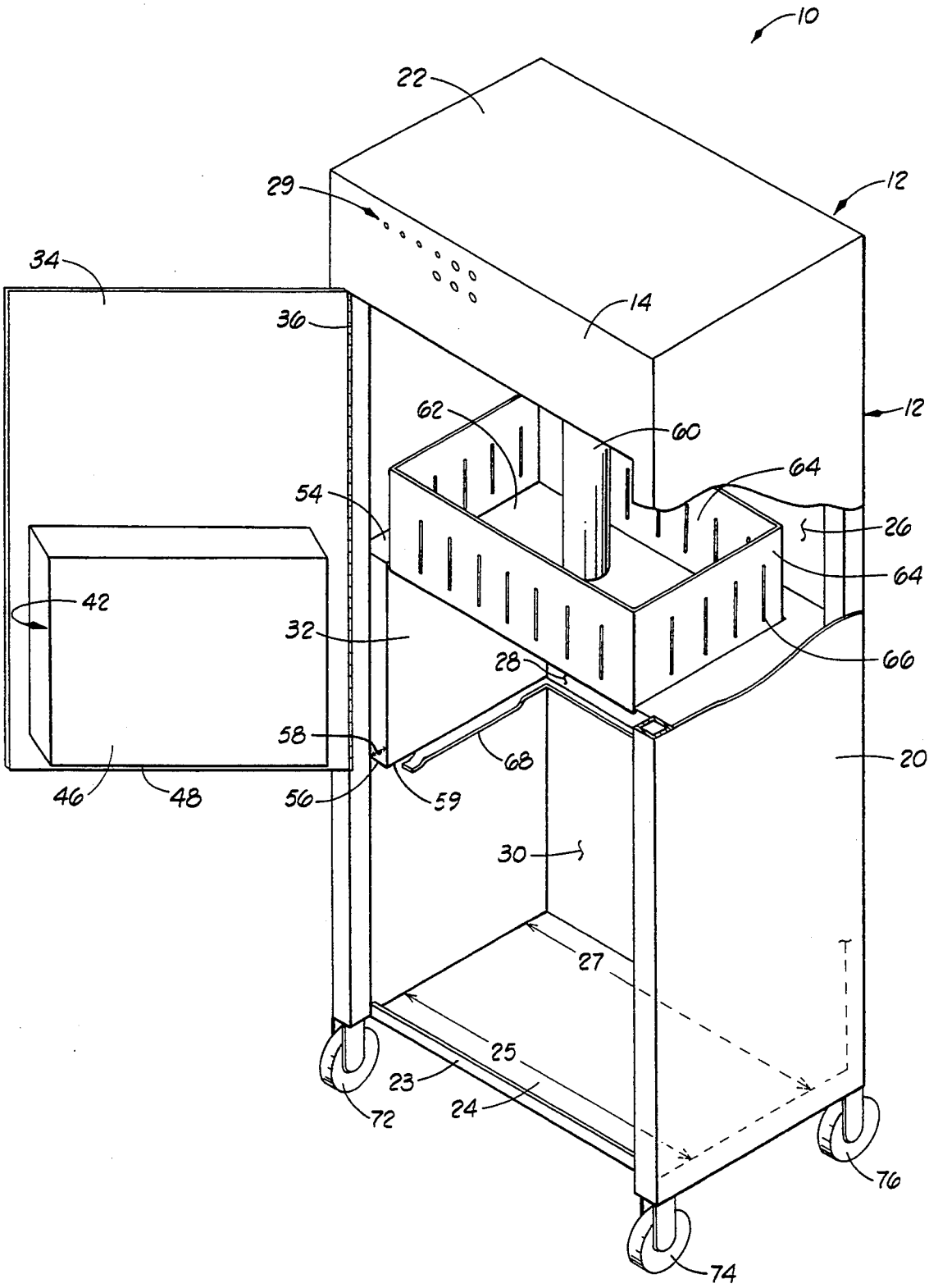
FIG. 2 is a front isometric representation of the compactor of FIG. 1 with parts removed.
Figure 3:
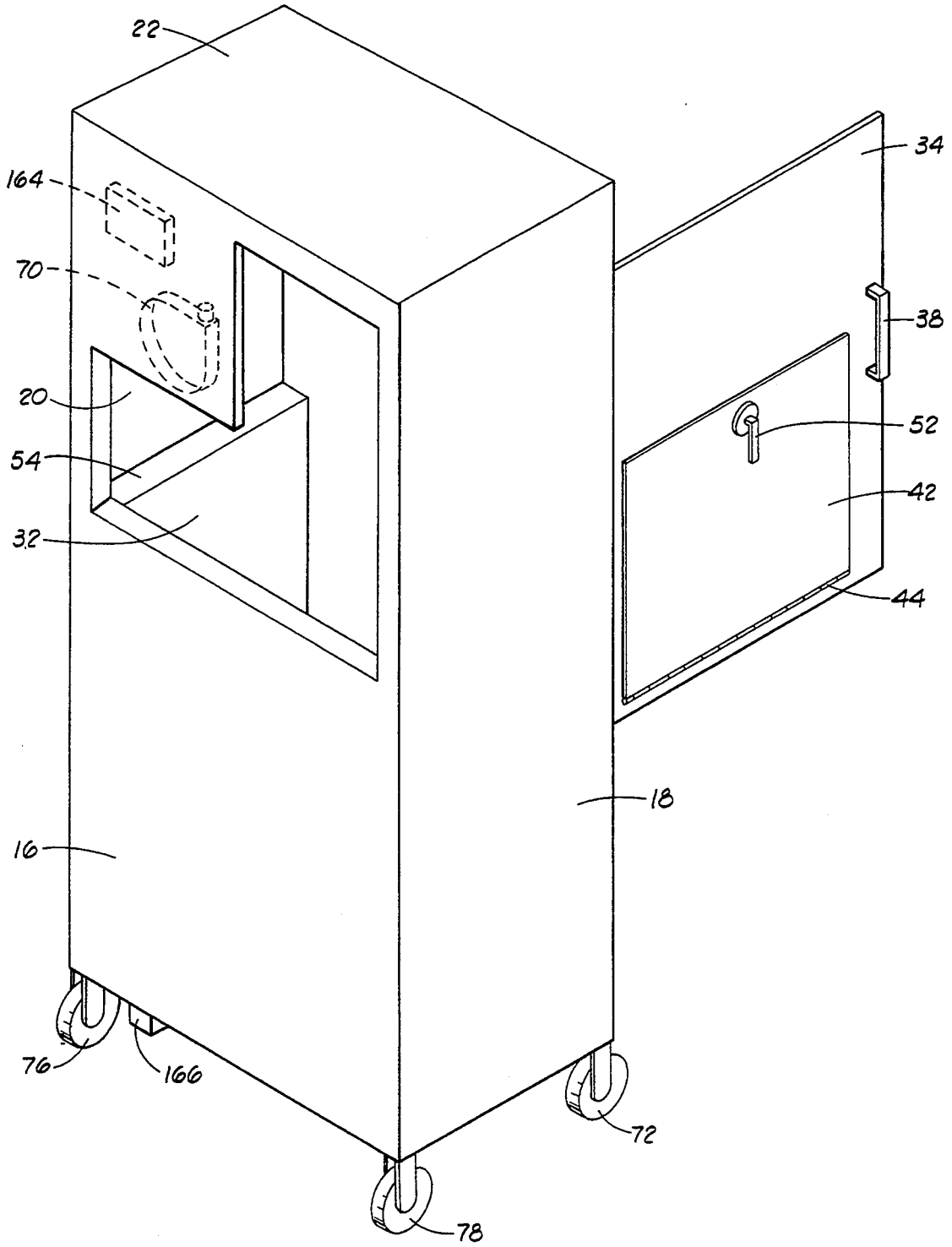

Turning now to FIG. 1, there is shown therein a combination material compacting and transporting apparatus of the present invention designated generally by the reference numeral 10. The apparatus 10 comprises a housing 12 and a material transport cart 40. Referring now to FIGS. 2 and 3, the housing 12 has a front panel 14, a rear panel 16, side panels 18 and 20, top 22 and bottom 24. Preferably the panels are made of a material such as stainless steel.

The top panel 22 forms the top of the housing 12 and the bottom panel 24 forms the bottom of the housing 12. The side panels 18 and 20 extend from the top panel 22 down to the bottom panel 24. An upwardly extending lip 23 is on the front side of bottom panel 24, thereby forming a drip pan to help contain liquids inside the housing 12.

The housing 12 defines three chambers therein, the upper most being a mechanical chamber 26, the center being a reception chamber 28 and the lower most being a storage chamber 30. The reception chamber 28 generally extends from the lower part to the upper part of the protruded wall members 32. The storage chamber 30 extends from the reception chamber 28 to the bottom 24 and the mechanical chamber 26 extends from the reception chamber 28 up to the top 22.

The rear panel 16 preferably extends from the bottom 24 up through the reception chamber 28, providing an opening for access to the mechanical chamber 26. A removable cover (not shown) may be used to cover the opening between the rear panel 16 and the top 22.

The front panel 14 preferably extends down from the top 22 at least partly covering the mechanical chamber 26. Thus, front panel 14 provides a mounting location for controls 29 as well as increasing the structural strength of the housing 12.

The storage chamber has a front side with a width 25 and a rear side with a width 27. The width 25 is preferably larger than the width 27. In this way compacted material is easier to remove from the storage chamber 30.

A housing door 34 is secured to the housing 12 by a hinge such as piano hinge 36. The housing door 34 can be secured in a closed position by handle 38 (FIG. 3). When closed, the housing door 34 extends down from the front panel 14 to the lower part of the protruded wall members 32. The remainder of the front of the housing 12 is open to receive a material transport cart 40 (FIGS. 4 and 5) which is described in detail below. The housing door 34 has an opening therein through which material can be deposited into the reception chamber.

A hopper door 42 is secured to the housing door 34 by a hinge such as piano hinge 44 and by handle 52. The hinge 44 is preferably at the bottom of the hopper door 42 so the hopper door can be opened at the top. Preferably the hopper door 42 will open less than 90°, in this way liquids which are spilled or splashed on interior wall 46 of the hopper door 42 will be pulled by gravity to the lower drip edge 48 of the hopper door 42.

The interior wall 46 of the hopper door 42 generally aligns with protruding walls 32 when the housing and hopper doors, 34 and 40 are closed. Therefore, the horizontal cross-sectional area of the reception chamber 28 is less than the horizontal cross-sectional area of the storage chamber 30.

The protruded wall members 32 are connected to the housing 12 by an upper return member 54 and a lower return member 56 (FIG. 2). Preferably the lower return member 56 is connected to the wall members 32 such that angle 58 is less than 90°. In this way, liquid which may be splashed on protruding walls 32 or on return member 56 will be pulled by gravity to the drip edge 59 or apex of angle 58.

A hydraulic cylinder 60 is connected to the top panel 22 of housing 12. A ram 62 is connected to the cylinder 60 for generally vertical movement along a path between a retracted position in which the ram is within the upper portion of the reception chamber 28 and an extended position in which the ram extends into the storage chamber 30. The hydraulic cylinder 60 may be powered by a suitable electric motor and pump, such devices are commonly known in the art and are not described herein.

A skirt 64 is secured around the periphery of the ram 62 and extends upward therefrom. The skirt 64 is of sufficient height that the upper portion of the skirt 64 remains in the reception chamber 28 when the cylinder 60 is fully extended and the ram 62 is in the upper portion of the storage chamber 30. In this way the skirt 64 keeps the ram 62 generally aligned within the housing eliminating the need for guide rods. Slots, such as slot 66 are formed in the skirt 64 to allow liquid to flow on top of the ram 62 when material is being compacted and drain back out when the ram 62 is retracted. The combination of the protruding walls 32 and the skirt 64 prevents solid material from getting on top of the ram.

Guide rails 68 are secured to the housing 12 below the lower return member 56. As will be discussed in more detail below, the guide rails 68 receive and help hold a receptacle such as a plastic bag into which material is compacted.

An odor control device, such as deodorizer 70 may be connected to the housing in the mechanical chamber 26. The deodorizer 70 is preferably equipped with an exhaust fan to circulate or remove air from within the housing 12.

Wheels 72, 74, 76, and 78 may be secured to bottom 24 to facilitate moving the housing 12. Preferably two of the wheels are caster type wheels and at least two of the wheels are provided with a braking mechanism.

Figure 4:
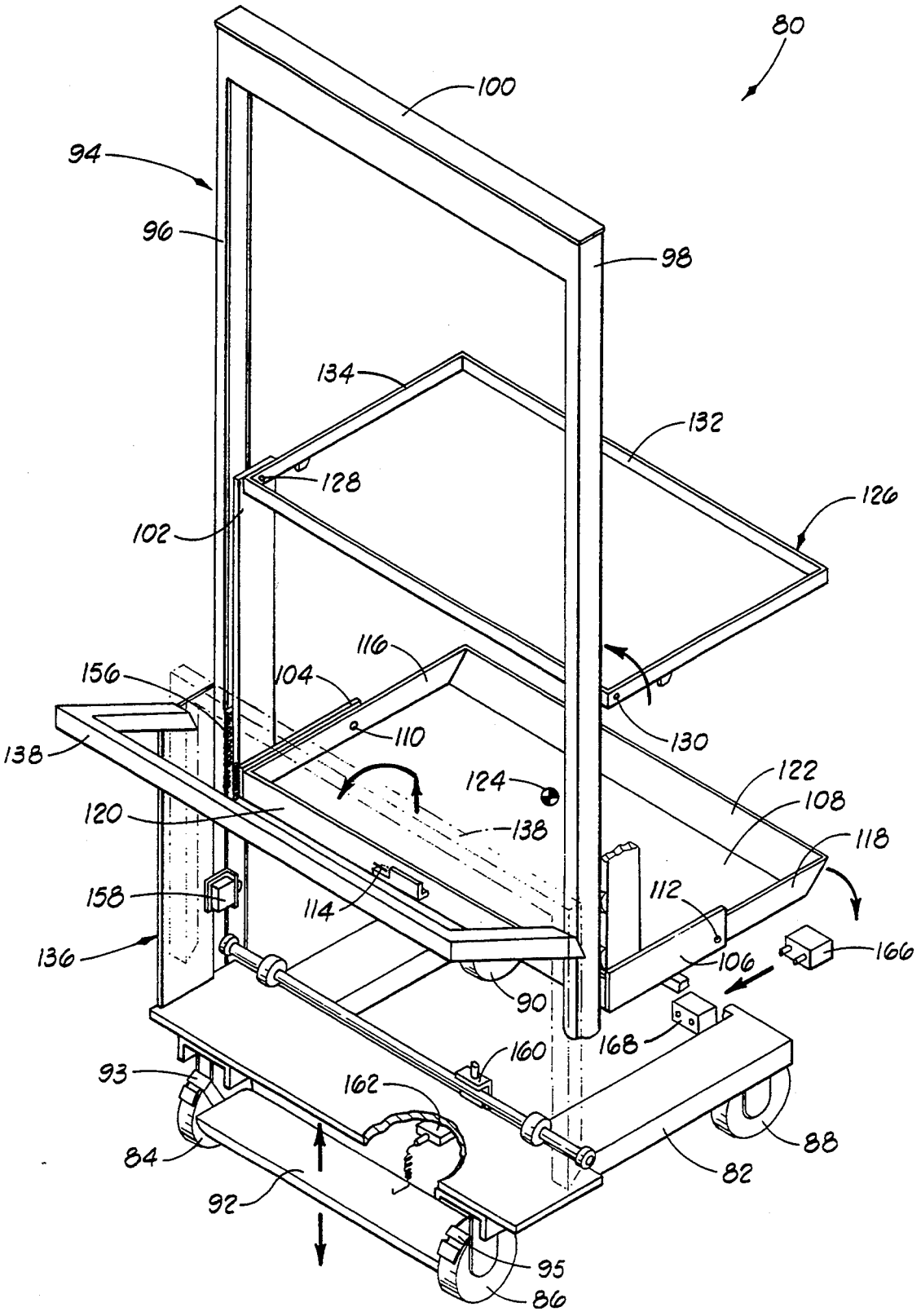
FIG. 4 is a rear isometric representation of the cart of FIG. 1 with parts removed.
Figure 5:
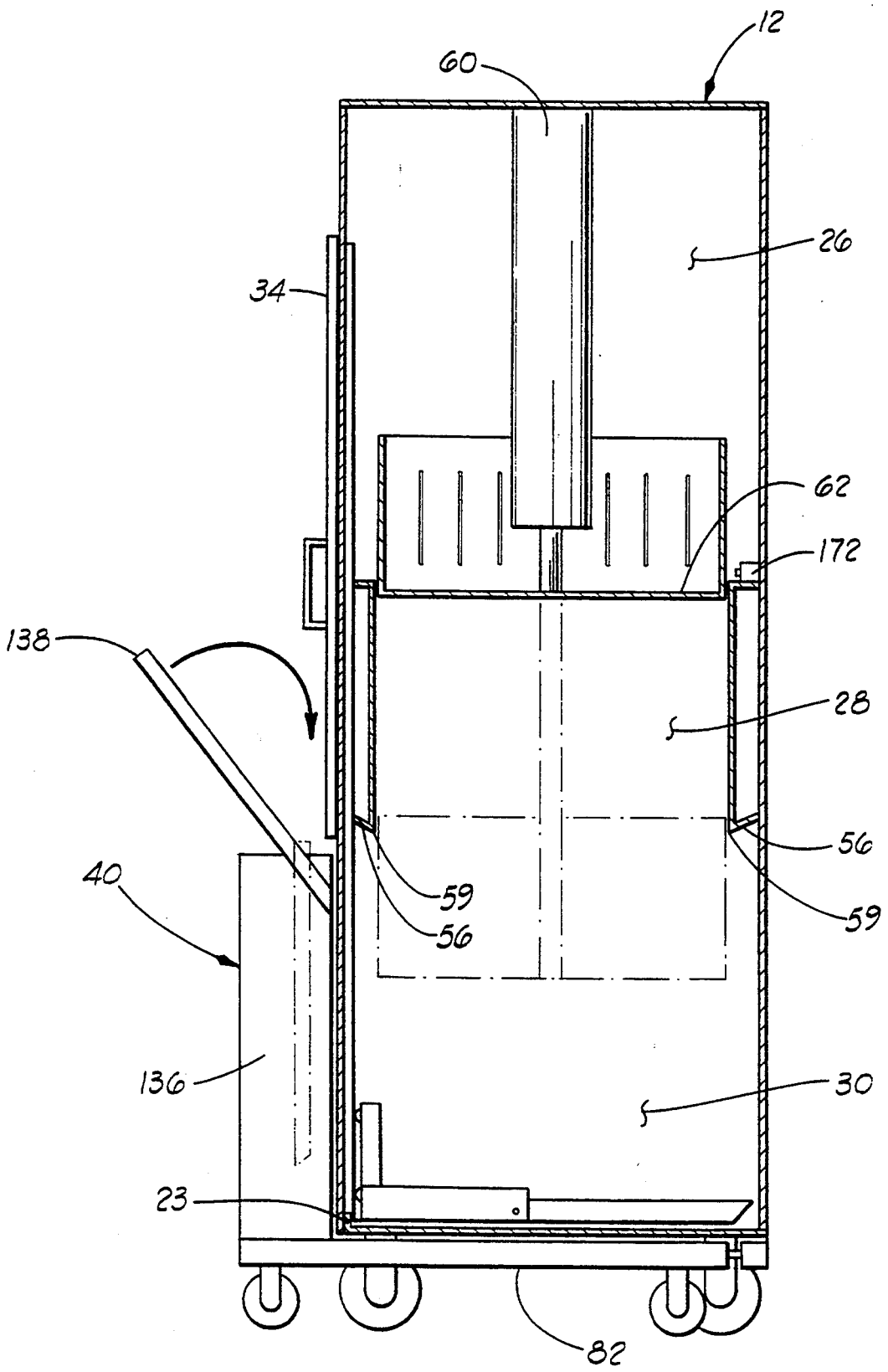
FIG. 5 is a rear isometric representation of a portion of the cart of FIG. 4.

Referring now to FIGS. 4 and 5 shown therein is a cart 40 for transporting material made in accordance with the present invention. In one preferred embodiment the cart 40 fits into the housing 12 so that material may be compacted directly thereon. However, the present invention is not limited to such, and the cart 40 may be used independently. The cart 40 has a base 82 supported by wheels 84, 86, 88 and 90. Preferably wheels 88 and 90 are caster type wheels.

A foot pedal 92 is connected to the base between wheels 84 and 96. When depressed, the foot pedal 92 activates wheel breaks 93 and 95 to lock wheels 84 and 86 thereby preventing the cart from moving. When the foot pedal 92 is raised the wheels 84 and 86 are free to rotate.

A frame 94 is secured to the base 82 and extends up therefrom. Preferably the frame comprises vertical channels 96 and 98 and cross channel 100. A sub-frame 102 is slidingly connected to vertical channels 96 and 98. The sub-frame 102 has vertical extending arms 104 and 106 connected to the lower portion thereof for pivotally supporting a lift plate 108.

The lift plate 108 is connected to the sub-frame 102 at pivot points 110 and 112 as well as by latch 114. The lift plate 108 is concave or in the shape of a basin, having sides 116 and 118, back 120 and front lip 122. Thus, the lift plate 108 can catch and hold liquid. The pivot points 110 and 112 are located such that the center of gravity 124 of the lift plate 108 is between the pivot points, 110 and 112, and the front lip 122. In this way, when latch 114 is released the lift plate 108 will rotate lowering the front lip 122 from a generally horizontal position wherein it supports the material to a second position thereby dumping material off of the lift plate 108.

In an alternative embodiment, screws may be rotatively connected to the base 82 and extend upwardly therefrom. Then the lifting plate may be secured to the screws such that when the screws are rotated the lift plate raises or lowers.

A bag rim 126 is pivotally connected to the upper portion of the sub-frame 102 at pivot points 128 and 130. In this way, the front member 132 may be lifted allowing material to be dumped when the lift plate 108 is rotated. Preferably an elastomeric gasket 134 is connected to the upper edge of the bag rim 126.

A mechanical housing 136 (FIGS. 1 and 6) is mounted on the base 82 to conceal a winch mechanism for lifting and lowering sub-frame 102. The mechanical housing 136 also contains a foldaway handle 138. The foldaway handle 138 may be lowered to a stored position (as indicated by phantom lines in FIG. 1) in the mechanical housing 136 when not in use or may be raised and rotated to a working position to allow the operator to move the cart 40.

Preferably an electro-mechanical winch mechanism 140 including a power source such as a battery 142, a drive motor 144, a drive linkage 146 and a control switch 148 is provided to lift sub-frame 102. When activated, the drive motor 144 rotates axle 150, thereby causing lift chains 152 and 154 to lift or lower the sub-frame 102. Springs 156 (FIG. 4) are connected to the sub-frame 102 and to the lifting chains 152 and 154 to keep slack out of the lifting chains when the sub-frame 102 is being lifted or lowered. However, a purely mechanical winch mechanism may be used such as by replacing motor 144 with a hand crank.

Preferably safety switches, such as switches 158 and 160 stop the lifting or lowering of the sub-frame when it reaches a predetermined high or low position. In addition, brake sensor 162 prevents the winch mechanism 140 from operating unless the wheel brakes 93 and 95 are locked.

A battery charger 164 (FIG. 3) located in the mechanical chamber 26 of the housing 12 may be provided to recharge the battery 142 in the cart 40. Preferably the battery charger 164 is connected to an electrical contact unit 166 under the bottom panel 24 of the housing 12. The contact unit 166 mates with contact unit 168 mounted on the front of the base 82 of the cart 40. The contact unit 168 on the cart 40 is connected to the battery 142. Thus, when the cart 40 is pushed up to the housing 12 a complete electrical circuit is made and the battery 142 is charged by the battery charger 164. The contact unit 166 has spring loaded contact pins and the contact unit 168 has mating contact pads. The pads on the contact unit 168 are oversized to provide contact even though the position of the cart 40 may vary slightly. Similarly the contact pins on contact unit 166 are spaced apart to mate with the contact pins.

Sensors, such as sensors 170, 171 (FIG. 1) and 172 (FIG. 6) are also provided in the housing 12 to prevent the operation of the cylinder 60 when the hopper door 42 or housing door 34 are open. Controls and status lights 29 provide for activation of the apparatus as well as indicating whether one of the sensors is blocking operation.

Operation

In operation, a container such as a plastic bag (not shown) is placed on the lift plate 108 and draped over the bag rim 126 and elastomeric gasket 134. The bag rim 126 holds the bag open and ready for receiving material. The cart 40 is then pushed up to the housing 12 such that the base 82 of the cart 40 is under housing bottom 24. In this position, the lift plate 108 is in the reception chamber 28 and the bag rim 126 is between guide rail 68 and lower return member 56. As the bag rim 126 enters the housing 12 the guide rails 68 lift the bag rim 126 slightly causing the bag to be sealed against the lower return member 56. In this way any liquid which may be splashed during the lift process remains inside the bag or drips into the bag from the apex of angle 58.

Once the cart 40 is in position for compacting with the lift plate 108 in the housing 12, foot pedal 92 is depressed. The lift plate 108 is then lowered so that the back 120 of the lift plate 108 engages lip 23 to lock the cart in the compacting position. The handle 138 is then rotated, lowered and locked in the storage position in the mechanical housing 136. The housing door 34 is then closed and the apparatus 10 is ready to accept and compact material.

To compact material the hopper door 42 is opened and the material is placed in the housing 12 therethrough. The hopper door 42 is then closed and controls 29 are activated causing the ram 62 to move generally vertical from a retracted position to an extended position thereby compacting the material into a container in the storage chamber 30. Any liquid which may be splashed onto protruding walls 32 or return member 56 is pulled gravitationally to apex of angle 58 where it drips back into the container. Similarly any liquid which is splashed or spilled on the interior wall 46 of the hopper door 42 is pulled gravitationally to drip edge 48 where it drips back into the container. If some liquid manages to escape the container, then it is caught and retained either on the lift plate 108 or the bottom panel 24 of the housing 12. If liquid is present during the compacting of the material it may run on top of the ram 62 through slots 66 in the skirt 64 thereby preventing the liquid from overflowing the container. The ram 62 then returns to the retracted position and the apparatus 10 is ready to receive more material. As the ram 62 returns to the retracted position any liquid present on top of the ram 62 runs back out through the slots 66 in the skirt 64 and into the container.

To remove and dump the compacted material the housing door 34 is opened and the foldaway handle 138 is unlocked, lifted and rotated into the working position. The lift plate 108 is raised slightly to release the cart 40 from the housing 12 and foot pedal 92 is lifted to release brakes 93 and 95. The cart 40 is then pulled from the housing 12 and pushed or pulled to the dump location. The bag rim 126 serves to hold the material on the lift plate 108 during transit.

Once the dump location is reached (which is generally a trash bin) foot pedal 92 is depressed locking the cart 40 into position. The bag rim 126 is then rotated up out of the way so the material may be dumped. The lift plate 108 may then be raised to the desired height by activating the winch mechanism 140. The operator then may pull handle 114 allowing the lift plate 108 to rotate or tilt down dumping the material as well as any liquid which may be present on the lift plate 108. The lift plate 108 may then be lowered and the cart 40 returned to the housing 12. Thus, compacted material may be removed from the housing 12 and dumped without the operator touching the material.

While preferably the cart 40 and the housing 12 are used together as an integral unit, the cart 40 may be used to transport materials from different compactors. The cart 40 may be used with other compactors by removing the compacted material from the compactor and placing it on the cart 40. The cart 40 can then be used to transport, lift and dump the material.

The housing 12 may also be used without the cart 40 by replacing housing door 34 with a door which will extend from front panel 14 down to bottom panel 24.

Embodiment of FIGS. 7 through 12

Figure 7:
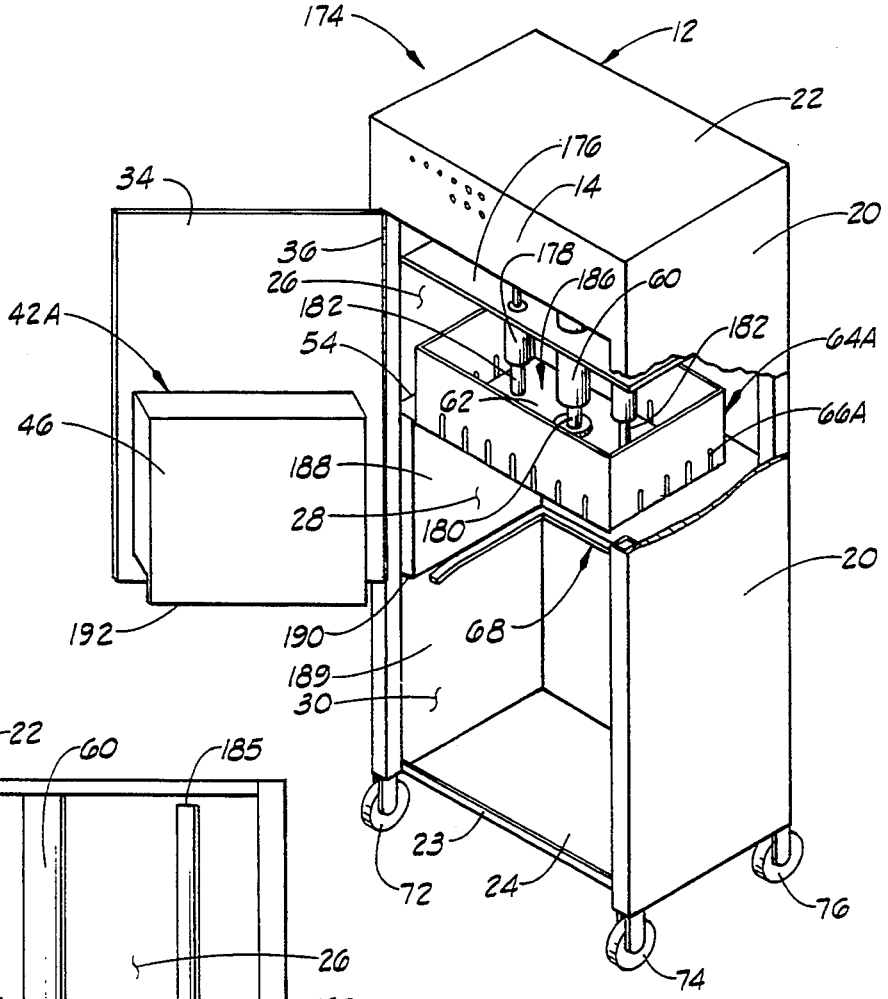
FIG. 7 is a perspective view of another compacting apparatus constructed in accordance with the present invention.
Figure 8:
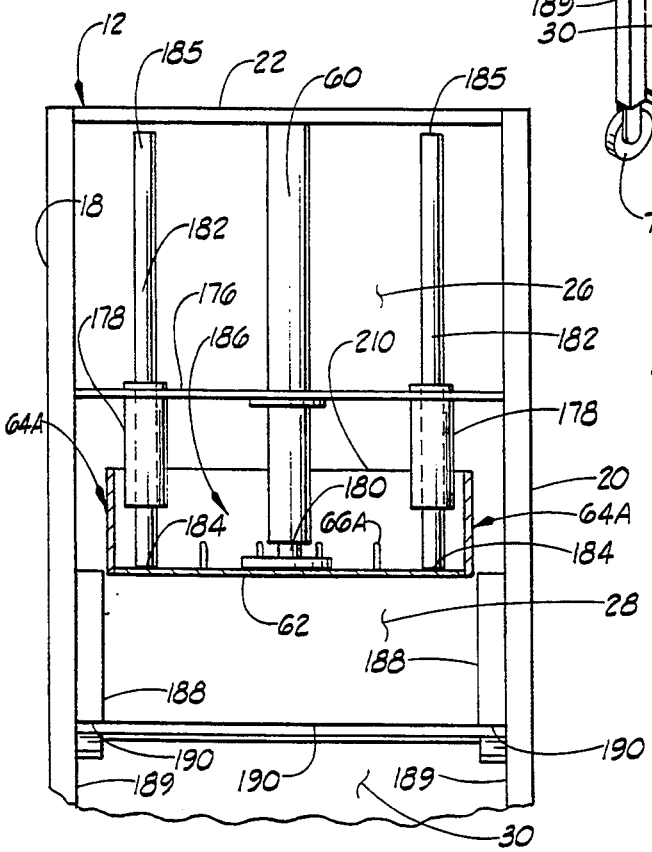
FIG. 8 is a front elevation of a portion of the compacting apparatus shown in FIG. 7.

Referring now to FIGS. 7 and 8, shown therein and designated by reference character 174 is another preferred embodiment of the compactor. The compactor 174 is identical to the compactor of the apparatus 10 described hereinabove with the exception of a few modifications.

One modification is the addition of a mounting plate 176, which extends across the housing 12 at a medial point of the mechanical chamber 26. A pair of guide bushings 178 and the cylinder 60 are attached to the mounting plate 176. The cylinder has a ram rod 180 which is connected to the ram plate 62 to move the ram plate 62 up and down.

As best seen in FIG. 8, the cylinder 60 is secured to the mounting plate 176 at a medial point of the cylinder 60. Mounting the cylinder 60 in this manner provides better stability and operation of the cylinder 60 than securing the cylinder 60 solely at the end of the cylinder 60.

A guide rod 182 is journaled through each one of the guide bushings 178. One end 184 of each guide rod 182 is secured to the ram plate 62 and the other end 185 of each guide rod 182 is unattached. As the ram rod 180 moves the ram plate 62, each guide rod 182 travels through the corresponding guide bushing 178 to control the path of the ram plate 62.

As illustrated by FIGS. 7 and 8, the ram plate 62 and the four walls of the ram skirt 64A define a ram chamber 186 and the ram skirt 64A walls have a plurality of slots for allowing liquid to enter into and drain out of the ram chamber 186. One of the slots is designated by reference character 66A and is generally representative of the slots through the ram skirt 64A. The slots 66A extend to the upper surface of the ram plate 62 in order to drain substantially all liquid from the ram chamber 186.

The receiving chamber walls 188 are spaced a distance inward from the storage chamber walls 189. A substantially horizontal reducing wall 190 extends between the receiving chamber walls 188 and the storage chamber walls 189. It should be appreciated that the reducing wall 190 overhangs a perimeter portion of the storage chamber 30 at the rear and at both sides of the housing 12. Furthermore, it should be understood that the ram plate 62 is sized and shaped to move through the receiving chamber 28 with only slight clearance between the lateral edges of the ram plate 62 and the receiving chamber walls 188.

As illustrated by FIG. 7, another feature of the compactor 174 is a lip 192 extending downward from the interior wall 46 of the hopper door 42A. As described hereinbelow, the lip 192 pivots behind the front of a trash bag in the storage chamber 30 to secure the front side of the trash bag and to deflect material into the trash bag.

Figure 9:
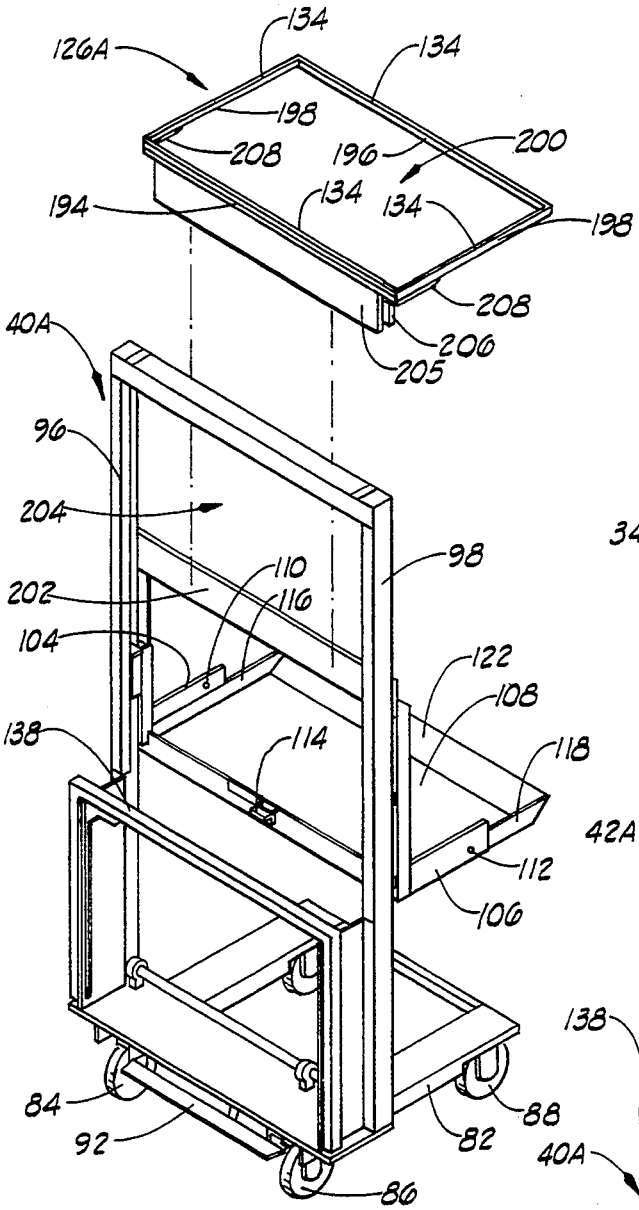
FIG. 9 is an exploded, perspective view of another cart constructed in accordance with the present invention.

Turning now to FIG. 9, shown therein and designated by reference character 40A is another preferred embodiment of the cart 40. The cart 40A is exactly like the cart 40, except that the cart 40A has a detachable bag holder 126A.

Instead of being pivotable like the bag rim 126 of the cart 40, the bag holder 126A is a removable component of the cart 40A. The bag holder 126A has a rear member 194, a front member 196 and side members 198 to define a bag holder opening 200. The bag holder opening 200 is sized and shaped such that the closed end of a trash bag may be inserted downward through the opening 200 and the sides of the trash bag then draped outwardly over the members 194, 196 and 198 to suspend the trash bag from the bag holder 126A.

Turning to the cart 40A itself, a horizontal bar 202 extends between the vertical channels 96 and 98 of the cart 40A. The vertical channels 96 and 98, the cross channel 100 and the horizontal bar 202 define a hopper opening 204 of the cart 40A.

For detachable mounting of the bag holder 126A, a pair of straddle plates 205 and 206 extend downward from the rear member 194 of the bag holder 126A. When the bag holder 126A is mounted to the cart 40A, the horizontal bar 202 suspends the bag holder 126A in a substantially horizontal position. The presence of one of the straddle plates 205 and 206 on each side of the horizontal bar 202 prevents the bag holder 126A from being dislodged from the cart 40A.

With this construction, the bag holder 126A remains mounted to the cart 40A while the cart 40A is being rolled into and out of the storage chamber 30 of the compactor 174. The bag holder 126A may be detached and placed out of the way, however, when a trash bag full of compacted material is to be dumped.

It should be appreciated that the elastomeric gasket 134 is secured to the upper surfaces of the rear member 194, the front member 196 and the side members 198 of the bag holder 126A. It should also be noted that a ramp member 208 protrudes from the lower surface of each side member 198 along a rear portion of the side member 198.

Figure 10:
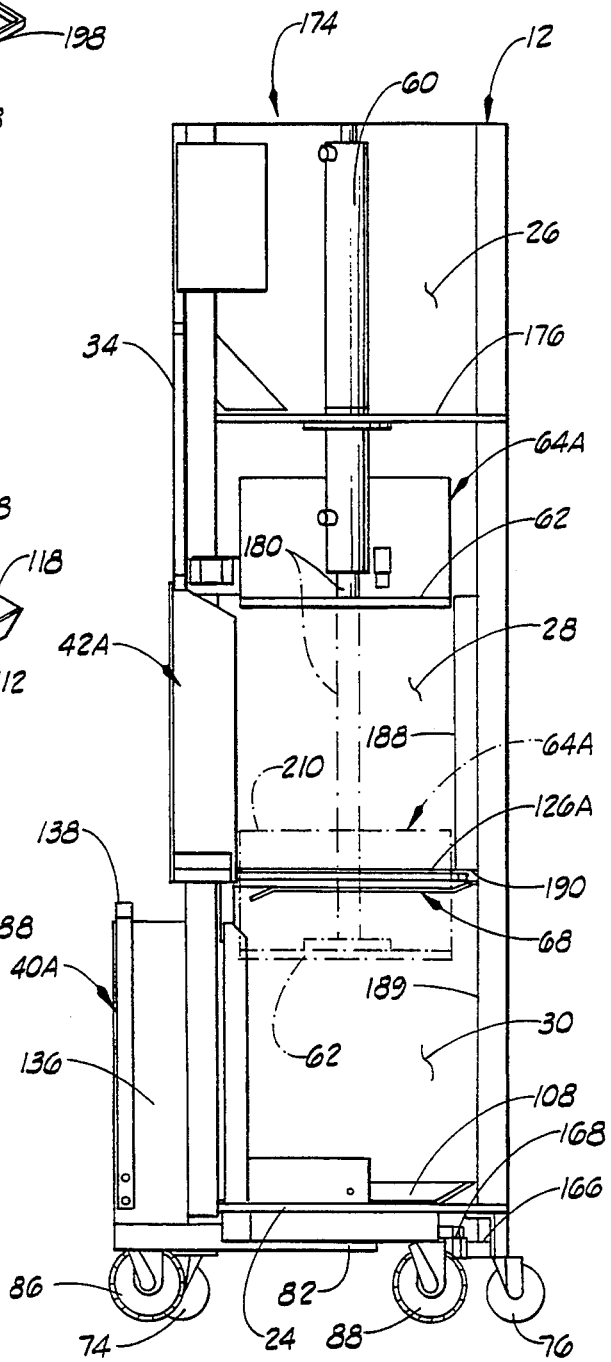
FIG. 10 is a partly sectional, partly diagrammatical side view of the cart shown in FIG. 9 in the compacting position with the compacting apparatus of FIG. 7.

With reference now to FIG. 10, shown therein is the cart 40A in a parked position with the compactor 174. In the parked position, the bag holder 126A and lift plate 108 of the cart 40A are disposed within the storage chamber 30 of the compactor 174. In addition, the mechanical housing 136 of the cart 40A is locked in place to the housing 12 of the compactor 174. Thus the mechanical housing 136 of the cart 40A closes the front opening to the storage chamber 30.

It should be appreciated that the housing door 34 is closed to secure the cross channel 100 and the vertical channels 96 and 98 of the cart 40A against the housing 12 to lock the cart 40A in the parked position. With the housing door 34 closed, material may be deposited into the receiving chamber 28 by opening the hopper door 42A. Material may then be inserted through the hopper opening 204 of the cart 40A and into the receiving chamber 28 of the housing 12.

In the parked position, the base 82 of the cart 40A is positioned underneath the bottom 24 of the housing 12 of the compactor 174. When locked in place, the electrical contact 168 of the cart 40A engages the electrical contact 166 of the compactor housing 12 for charging the rechargeable battery 142 of the cart 40A.

With the ram rod 180 of the cylinder 60 fully retracted (as shown by solid lines in FIG. 10), the ram plate 62 is in a storage position at the upper end of the receiving chamber 28 to allow trash to be deposited into the receiving chamber 28 through the opening of the hopper door 42. To compact material down into the storage chamber 30, the ram rod 180 of the cylinder 60 is extended to move the ram plate 62 into a compacting position (illustrated by phantom lines in FIG. 10) in the storage chamber 30.

It should be appreciated that, at the lowest position of the ram plate 62, the upper end 210 of the ram skirt 64A is above the storage chamber 30. In this manner, solid trash material is prevented from getting inside the ram skirt 64A and interfering with the movement of the ram rod 180. Liquids, on the other hand, may enter the ram skirt 64A through the ram skirt slots 66A. When the ram plate 62 is lifted by the ram rod 180, the liquids run out through the ram skirt slots 66A and fall by gravity into the storage chamber 30.

Figure 11:
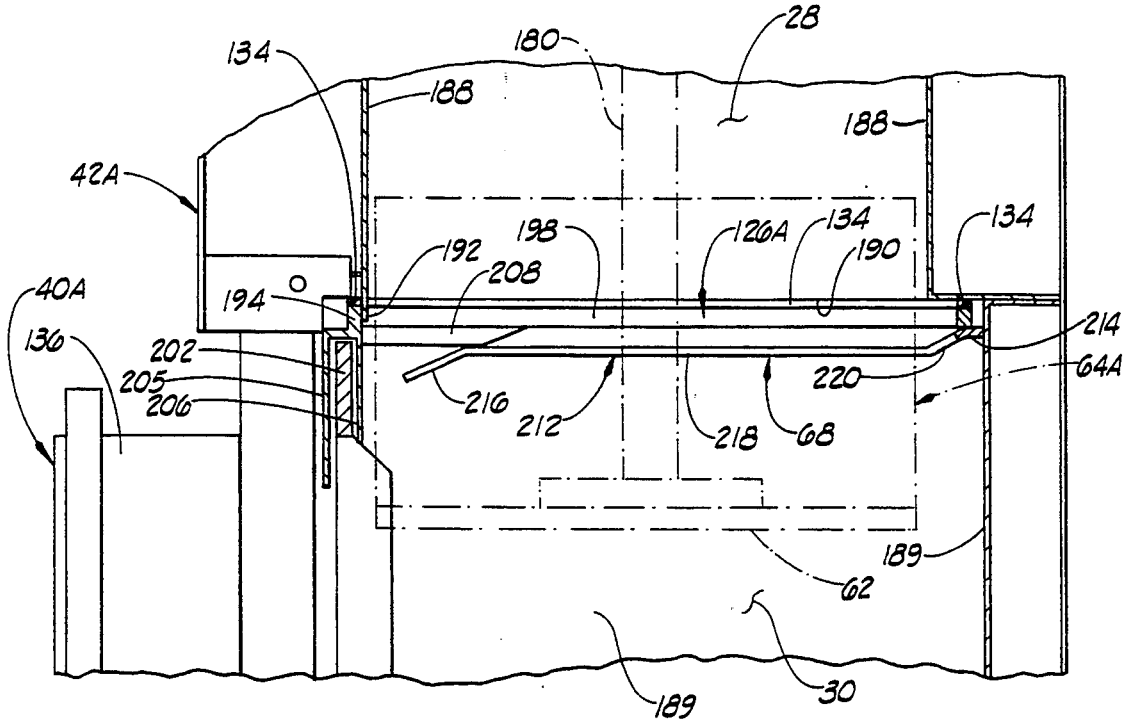
FIG. 11 is a view of a portion of FIG. 10 illustrating the cooperation of the guide rails of the compactor housing with the bag rim of the cart.

Turning now to FIG. 11, shown therein is an enlarged view of a medial portion of FIG. 10 which illustrates the cooperation of the bag holder 126A with the compactor 174. The guide rails 68 include two side rails 212 and a rear rail 214. The rear rail 214 extends straight across the rear interior of the housing 12. Each side rail 212, on the other hand, includes a front ramp 216, a substantially horizontal medial portion 218 and a rear ramp 220.

As the bag holder 126A enters the storage chamber 30 of the compactor 174, the front member 196 of bag holder 126A engages the front ramp 216 of both side rails 212. The front ramps 216 elevate and guide the bag holder 126A into the storage chamber 30.

The front member 196 of the bag holder 126A travels along the medial, horizontal portion 218 of the side rails 212 until the bag holder 126A is almost completely disposed within the storage chamber 30. Eventually, the front member 196 of the bag holder 126A reaches the rear ramps 220 of the side rails 212. At substantially the same time, the ramp members 208 of the bag holder 126A engage the front ramp 216 of the side rails 212.

The front ramps 216 and rear ramps 220 of the compactor 174 cooperate with the ramp members 208 and front member 196 of the bag holder 126A, respectively, to lift the bag holder 126A into the parked position shown in FIG. 11. In this position, the elastomeric gasket 134 of the bag holder 126A is compressed between the reducing wall 190 of the compactor housing 12 and the bag holder 126A.

Figure 12:
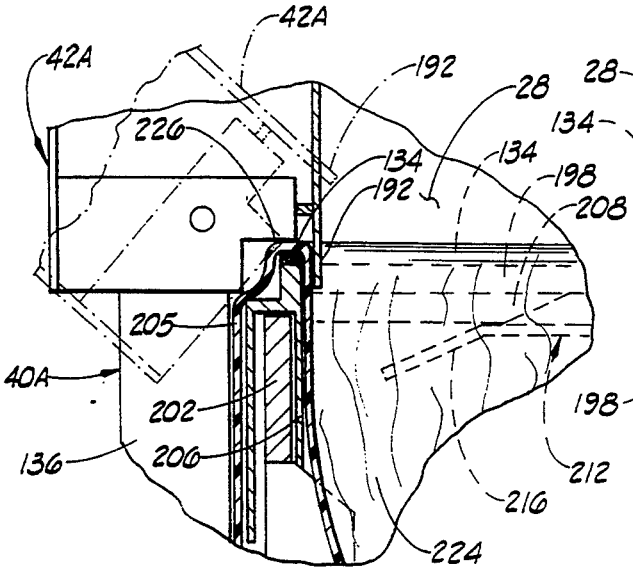
FIG. 12 is a view of a portion of FIG. 10 illustrating the cooperation of the hopper door of the compactor with the bag rim of the cart to provide a fluid seal at the front of a trash bag.

Referring now to FIG. 12, shown therein is an enlarged view of a front portion of FIG. 11 with a trash bag 224 in place for receiving trash. It should be appreciated that the thickness of the trash bag 224 is exaggerated for purposes of illustration.

The trash bag 224 should be sized to contain the volume of the storage chamber 30 and to be draped well over the outside of the bag holder 126A. With the hopper door 42A closed (as indicated by solid lines in FIG. 12), a bottom plate 226 of the hopper door 42A pushes the trash bag 224 against the elastomeric gasket 134 of the bag holder 126A to provide a fluid-tight seal along the front of the trash bag 224. Furthermore, the lip 192 of the closed hopper door 42A extends downward inside the trash bag 224 to prevent material, particularly liquids, from escaping to the outside of the trash bag 224.

When the hopper door 42A is pivoted open (as illustrated by phantom lines in FIG. 12), the lip 192 of the hopper door 42A extends over the front of the trash bag 224 to guide material deposited into the receiving chamber 28 down into the trash bag 224. Thus the lip 192 of hopper door 42A acts as a deflecting plate for material and a drip plate for liquids when the hopper door 42A is open.

Figure 13:
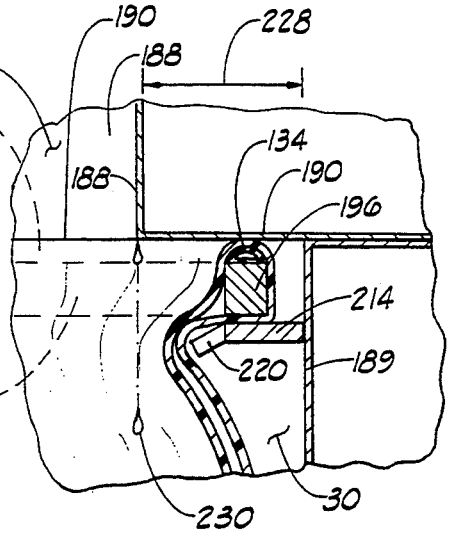
FIG. 13 is a view of a portion of FIG. 10 illustrating the cooperation of the compactor housing, the guide rails and the bag rim to provide a fluid seal at the sides and rear of a trash bag.

With reference now to FIG. 13, shown therein is an enlarged view of a rear portion of FIG. 11 with a trash bag 224 parked in the storage chamber 30 to receive trash material. The rear rail 214 supports the front member 196 of the bag holder 126A in the parked position.

In the parked position, the trash bag 224 is secured between the elastomeric gasket 134 of the bag holder 126A and the reducing wall 190 of the compactor housing 12. The elastomeric gasket 134 of the bag holder 126A is compressed to effect a fluid tight seal between the trash bag 224 and the reducing wall 190 of the compactor housing 12.

It should be appreciated that the elastomeric gasket 134 of the bag holder 126A and the reducing wall 190 of the compactor housing 12 cooperate to secure the trash bag 224 in a fluid tight seal along both sides and the rear of the trash bag 224. The construction for achieving a fluid tight seal along the front of the trash bag 224 has been described hereinabove. Thus a fluid tight seal is effected all around the open end of the trash bag 224 when the cart 40A is parked and locked to the compactor 174.

Furthermore, it should be understood that the reducing wall 190 of the compactor housing 12 extends a distance to the inside to overhang the side rails 212 and the rear rail 214. This distance is indicated by reference numeral 228 in FIG. 13. With this construction, any fluids falling or dripping from the receiving chamber 28 are certain to fall inside the trash bag 224. A drip, designated by reference numeral 230 in FIG. 13, illustrates this feature.

Finally, it should be appreciated that the compactor 174 and the bag holder 126A may be operated without the cart 40A. The bag holder 126A and trash bag 224 may be manually inserted into and removed from the storage chamber 30 of the compactor 174. The cart 40A, however, provides a convenient vehicle for transporting the bag holder 126A and trash bag 224 and for lifting and dumping the trash bag 224 filled with compacted material.

Changes may be made in the combination and arrangement of the various parts, and elements described herein without departing from the spirit and scope of the invention as defined in the following claims.

What is claimed is:

1. An apparatus for receiving and compacting material into a bag, the apparatus comprising:

a housing having an upper receiving chamber, an upper opening allowing access to the receiving chamber, a lower storage chamber communicating with the receiving chamber, a lower opening allowing access to the storage chamber, and a reducing wall separating the receiving chamber from the storage chamber, the reducing wall extending inward from the storage chamber;

a ram plate shaped for movement through the receiving chamber;

means for moving said ram plate between a storage position wherein said ram plate is spaced a distance from the storage chamber and a compacting position wherein said ram plate is disposed in the storage chamber;

a bag holder adapted to position a bag within the storage chamber with the open end of the bag disposed beneath the reducing wall; and an elastomeric gasket attached to the upper surface of said bag holder, said elastomeric gasket being compressible to effect a fluid-tight seal between the open end of the bag and the reducing wall;

wherein the bag holder and the reducing wall cooperate to keep material from escaping between the bag and said housing in the storage chamber.

2. An apparatus for receiving and compacting material into a bag, the apparatus comprising:

a housing having an upper receiving chamber, an upper opening allowing access to the receiving chamber, a lower storage chamber communicating with the receiving chamber, a lower opening allowing access to the storage chamber, and a reducing wall separating the receiving chamber from the storage chamber, the reducing wall extending inward from the storage chamber;

a ram plate shaped for movement through the receiving chamber;

means for moving said ram plate between a storage position wherein said ram plate is spaced a distance from the storage chamber and a compacting position wherein said ram plate is disposed in the storage chamber;

a bag holder adapted to position a bag within the storage chamber with the open end of the bag disposed beneath the reducing wall;

a hopper door mounted to said housing, said hopper door being movable between an open position wherein said hopper door allows deposit of material through the upper opening into the receiving chamber and a closed position wherein said hopper door closes the upper opening;

a lip extending from said hopper door a distance into the open end of the bag when said hopper door is in the closed position;

wherein the bag holder and the reducing wall cooperate to keep material from escaping between the bag and said housing in the storage chamber.

3. The apparatus of claim 2 wherein said lip extends angularly over the open end of the bag when said hopper door is in the open position.

4. An apparatus for receiving and compacting material into a bag, the apparatus comprising:

a housing having an upper receiving chamber, an upper opening allowing access to the receiving chamber, a lower storage chamber communicating with the receiving chamber, a lower opening allowing access to the storage chamber, and a reducing wall separating the receiving chamber from the storage chamber, the reducing wall extending inward from the storage chamber;

a ram plate shaped for movement through the receiving chamber; said ram plate is sized and shaped to have only slight clearance between the edges of said plate and said housing within the receiving chamber;

means for moving said ram plate between a storage position wherein said ram plate is spaced a distance from the storage chamber and a compacting position wherein said ram plate is disposed in the storage chamber;

a ram skirt extending upward from the perimeter of said ram plate to define a ram chamber, said ram skirt having a height such that the upper end of said ram skirt remains within the receiving chamber when said ram plate is in the compacting position to prevent entry of substantially solid material into the ram chamber, said ram skirt also having a plurality of slots therethrough for allowing substantially fluid material to enter into and drain from the ram chamber; and a bag holder adapted to position a bag within the storage chamber with the open end of the bag disposed beneath the reducing wall;

wherein the bag holder and the reducing wall cooperate to keep material from escaping between the bag and said housing in the storage chamber.

5. An apparatus for receiving and compacting material into a bag, the apparatus comprising:

a housing having an upper receiving chamber, an upper opening allowing access to the receiving chamber, a lower storage chamber communicating with the receiving chamber, a lower opening allowing access to the storage chamber, and a reducing wall separating the receiving chamber from the storage chamber, the reducing wall extending inward from the storage chamber;

a ram plate shaped for movement through the receiving chamber;

means for moving said ram plate between a storage position wherein said ram plate is spaced a distance from the storage chamber and a compacting position wherein said ram plate is disposed in the storage chamber;

a bag holder adapted to position a bag within the storage chamber with the open end of the bag disposed beneath the reducing wall;

a cart adapted to carry said bag holder for insertion of said bag holder into the storage chamber and for removal of said bag holder from the storage chamber;

a tray mounted to said cart below said bag holder, said tray being adapted to support the weight of a bag suspended by said bag holder and the material contained within the bag;

wherein the bag holder and the reducing wall cooperate to keep material from escaping between the bag and said housing in the storage chamber.

6. The apparatus of claim 5 wherein said tray is pivotable between a carrying position wherein said tray supports the bag and an unloading position wherein said tray is inclined for sliding the bag from said tray.

7. The apparatus of claim 5 further comprising:

means for moving said tray between a lower position wherein the bag is suspended from said bag holder for receiving material and an upper position wherein the bag is elevated for removal of the bag from said tray.

8. The apparatus of claim 7 wherein said means for moving said tray further comprises:

an electric winch mounted to said cart and operatively connected to said tray; and a battery connected to said electric winch.

9. The apparatus of claim 8 further comprising:

a battery charger mounted within said housing; and means for connecting said battery charger to said battery when said cart has located the bag holder in the storage chamber.

10. An apparatus for receiving and compacting material into a bag, the apparatus comprising:

a housing having a receiving chamber, a receiving opening allowing access to the receiving chamber, a storage chamber communicating with the receiving chamber and a storage opening allowing access to the storage chamber;

a cart adapted to position a bag in the storage chamber with the open end of the bag communicating with the receiving chamber of said housing such that said cart closes at least a portion of the storage opening, said cart also being adapted for transporting the bag out of the storage chamber to a bag dumping location;

compacting means, mounted within said housing, for compacting into the bag material deposited in the receiving chamber; and elevating means, mounted to said cart, for raising the bag from a storage level substantially even with the storage chamber of said housing to a dumping level substantially higher than the storage chamber of said housing in order to dump the bag from said cart into a trash bin without manually lifting the bag.

11. The apparatus of claim 10 wherein said elevating means comprises an electric winch.

12. The apparatus of claim 10 further comprising: dumping means, mounted to said cart, for dumping the bag from said cart without manually handling the bag.

13. The apparatus of claim 12 wherein said dumping means comprises a tray pivotally mounted to said cart.

14. The apparatus of claim 10 wherein said elevating means raises the bag in a substantially vertical direction.

15. An apparatus for receiving and compacting material into a bag, the apparatus comprising:

a housing having a receiving chamber, a receiving opening allowing access to the receiving chamber, a storage chamber communicating with the receiving chamber and a storage opening allowing access to the storage chamber;

a cart having a bag holder and a tray, the bag holder being adapted to position a bag in the storage chamber with the open end of the bag communicating with the receiving chamber of said housing and the tray being adapted to support the weight of the bag when containing material, said cart also being adapted for transporting the bag out of the storage chamber to a bag dumping location;

compacting means, mounted within said housing, for compacting into the bag material deposited in the receiving chamber; and elevating means, mounted to said cart, for raising the bag-carrying tray from a storage level substantially even with the storage chamber of said housing to a dumping level substantially higher than the storage chamber of said housing in order to dump the bag from said cart into a trash bin without manually lifting the bag.

16. The apparatus of claim 15 wherein said cart is adapted to close at least a portion of the storage chamber of said housing when said cart is positioning the bag within the storage chamber of said housing.

17. The apparatus of claim 15 wherein said elevating means comprises an electric winch.

18. The apparatus of claim 15 further comprising:

dumping means, mounted to said cart, for dumping the bag from said cart without manually handling the bag.

19. The apparatus of claim 15 wherein the tray is mounted to said cart to be movable between a bag-carrying position and a bag-dumping position.

20. The apparatus of claim 15 wherein said elevating means raises the bag in a substantially vertical direction.

21. The apparatus of claim 15 wherein the bag holder is removable from said cart in order to facilitate dumping the bag from the tray of said cart.

* * * * *